US006253780B1

(12) United States Patent
Salvoni et al.

(10) Patent No.: US 6,253,780 B1
(45) Date of Patent: Jul. 3, 2001

(54) METHOD FOR PREPARING A WELDING FLUID OF CONSTANT PHYSICO-CHEMICAL CHARACTERISTICS WITH TIME, AND A PLANT FOR ITS PREPARATION

(75) Inventors: Marco Salvoni, Milan; Giorgio Cuccoli, Florence; Roberto Remelli, Roverbella; Dante Di Lauro, Cesano Boscono, all of (IT)

(73) Assignee: Air Liquide Italia, S.R.L. (IT)

( * ) Notice: Subject to any disclaimer, the term of this patent is extended or adjusted under 35 U.S.C. 154(b) by 0 days.

(21) Appl. No.: 09/381,014

(22) PCT Filed: Dec. 31, 1998

(86) PCT No.: PCT/EP98/08517

§ 371 Date: Sep. 14, 1999

§ 102(e) Date: Sep. 14, 1999

(87) PCT Pub. No.: WO99/36223

PCT Pub. Date: Jul. 22, 1999

(30) Foreign Application Priority Data

Jan. 14, 1998 (IT) ..... MI98A0043

(51) Int. Cl.[7] ..... B23K 35/38
(52) U.S. Cl. ..... 137/3; 137/88; 137/93
(58) Field of Search ..... 137/3, 6, 88, 93, 137/101.19

(56) References Cited

U.S. PATENT DOCUMENTS 3,762,428 * 10/1973 Beck et al. ..... 137/88
5,674,382 * 10/1997 Chapman ..... 210/96.1

FOREIGN PATENT DOCUMENTS 536 491 * 4/1993 (EP) .
623 381 * 11/1994 (EP) .
2170731 * 8/1986 (GB) .

* cited by examiner

*Primary Examiner*—Stephen M. Hepperle
(74) *Attorney, Agent, or Firm*—Steinberg & Raskin, P.C.

(57) ABSTRACT

A method for preparing a welding fluid consisting of a mixture of at least two components. The method including the steps of withdrawing the mixture components from respective tanks and feeding them into a mixing zone at substantially identical pressures, monitoring the composition of the mixture formed, and if the composition is correct, feeding the mixture into a buffer tank to be stored.

20 Claims, 2 Drawing Sheets

METHOD FOR PREPARING A WELDING FLUID OF CONSTANT PHYSICO-CHEMICAL CHARACTERISTICS WITH TIME, AND A PLANT FOR ITS PREPARATION

FIELD OF THE INVENTION

This invention relates to a method for preparing a welding fluid in accordance with the introduction to the main claim. The invention also relates to a plant for preparing and storing said fluid in accordance with the introduction to the relative independent claim.

BACKGROUND OF THE INVENTION

As is well known, a welding fluid usually comprises a mixture of gases. The gases concerned are argon (Ar), helium (He), oxygen ($O_2$) and carbon dioxide ($CO_2$), the relative mixtures being binary or ternary, for example the mixtures can be:

a) Ar—$CO_2$;

b) Ar—$CO_2$—$O_2$;

c) Ar—He;

d) Ar—He—$CO_2$.

These gases are supplied to that region of an article at which the weld is to be made usually already mixed together.

It is known to use cylinders containing the mixture which are directly conveyed to the site at which the weld is to be made. This operation can however create safety problems in the workplace.

A system involving the preparation of welding mixtures on site is used where such mixtures are consumed in large quantity, it then being economically and logistically justified to use liquefied gas storage (Ar and/or $CO_2$).

It is also know to prepare such welding mixtures in which the components Ar and $CO_2$ are stored in the liquid phase (for example in large cryogenic tanks or cold evaporators) and the other components are stored in respective cylinders. The various components are mixed in known manner to obtain the final welding mixture. This known method (and relative plant) does not however ensure a mixture with constant composition characteristics. This negatively affects the execution of the weld, with the result that this latter often does not satisfy the severe codes which generally govern welding operations.

OBJECTS AND SUMMARY OF THE INVENTION

An object of this invention is therefore to provide a method enabling a welding mixture to be obtained, of which the physico-chemical characteristics (relative to the percentage of its components, its delivery pressure and similar parameters) remain constant with time, so ensuring optimum welding to satisfy the most severe codes.

A further object is to provide a method of the aforesaid type which is of reliable implementation and allows continuous delivery of the welding mixture.

A further object is to provide a method of the aforesaid type in which both the manner in which the welding mixture is generated and its composition can be remotely controlled.

Another object of the invention is to provide a plant for safely and reliably implementing the aforesaid method.

These and further objects which will be apparent to an expert of the art are attained by a method and plant for its implementation in accordance with the accompanying claims.

BRIEF DESCRIPTION OF THE DRAWINGS

The invention will be more apparent from accompanying drawings, which are provided by way of non-limiting example and on which.

DETAILED DESCRIPTION OF THE INVENTION

Figure 1:
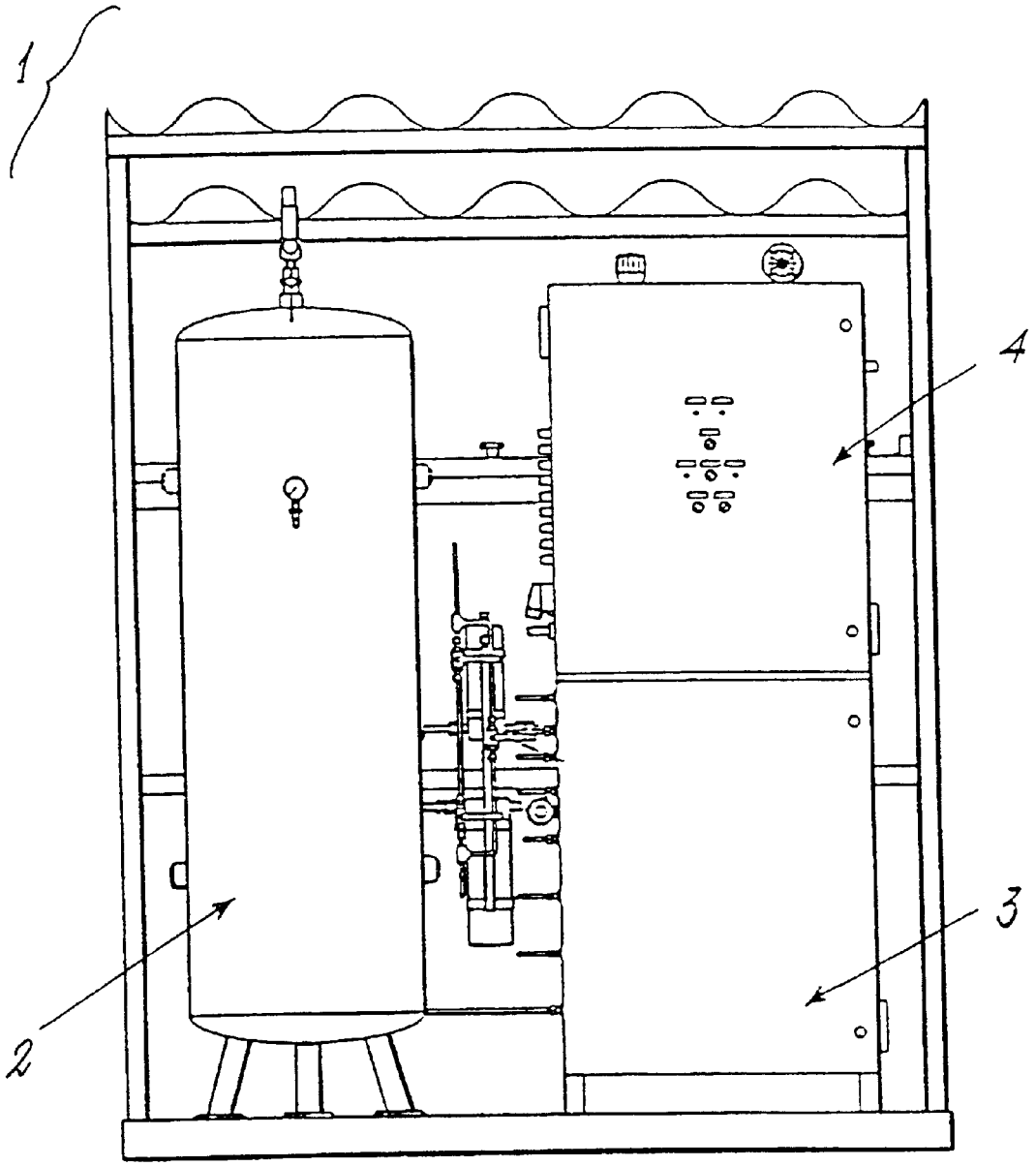
FIG. 1 is a front view of the plant of the invention.

With reference to said figures, the plant of the invention is indicated overall by 1 and comprises a buffer tank 2 for containing a welding mixture. The tank 2 is connected to a mixing unit 3 into which the component gases of the welding mixture are independently fed and from which the mixture formed is: fed to the tank 2. The mixture returns to the unit 3 to be then fed to the user, such as an operating region in which the weld is effected.

Finally, the plant comprises an analysis and control system 4 for the mixture formed by the unit 3 to maintain the pressure and the percentage ratio of the various mixture components within preset limits. This system also controls the operation of the plant 1.

With reference by way of example to a ternary mixture comprising argon, carbon dioxide and oxygen, the argon (in the liquid phase) being withdrawn from tanks, the carbon dioxide from cylinders or, if in the liquid phase, from a tank, and the oxygen from a cylinder, the cylinder(s) and tanks not being shown. Withdrawal is via feed lines 6, 7 and 8 respectively. The gases are present at higher than atmospheric pressure (for example argon is present in its tank at a pressure of about 13–14 bar) which is then reduced to about 10 bar. These lines-comprise respective solenoid valves which, under the control of a control unit 9 (schematically shown for example as a microprocessor or PC) provided in the analysis and control system 4, enable the gases to flow into the unit 3. This flow takes place at a controlled pressure via a pressure regulator 10 (in the case of the argon which, as stated, passes from 13–14 bar to 10 bar), 11 and 12 connected into the lines 6, 7 and 8 respectively, after the gases (argon and carbon dioxide) have been heated by suitable heaters 13 positioned in the respective lines 6 and 8. The regulators and heaters are all connected to and operated and controlled by the unit 9 of the system 4. The pressure in the lines 6 is also controlled by usual pressure switches 15 (only that in the line 7 being shown in

FIG. 2).

Figure 2:
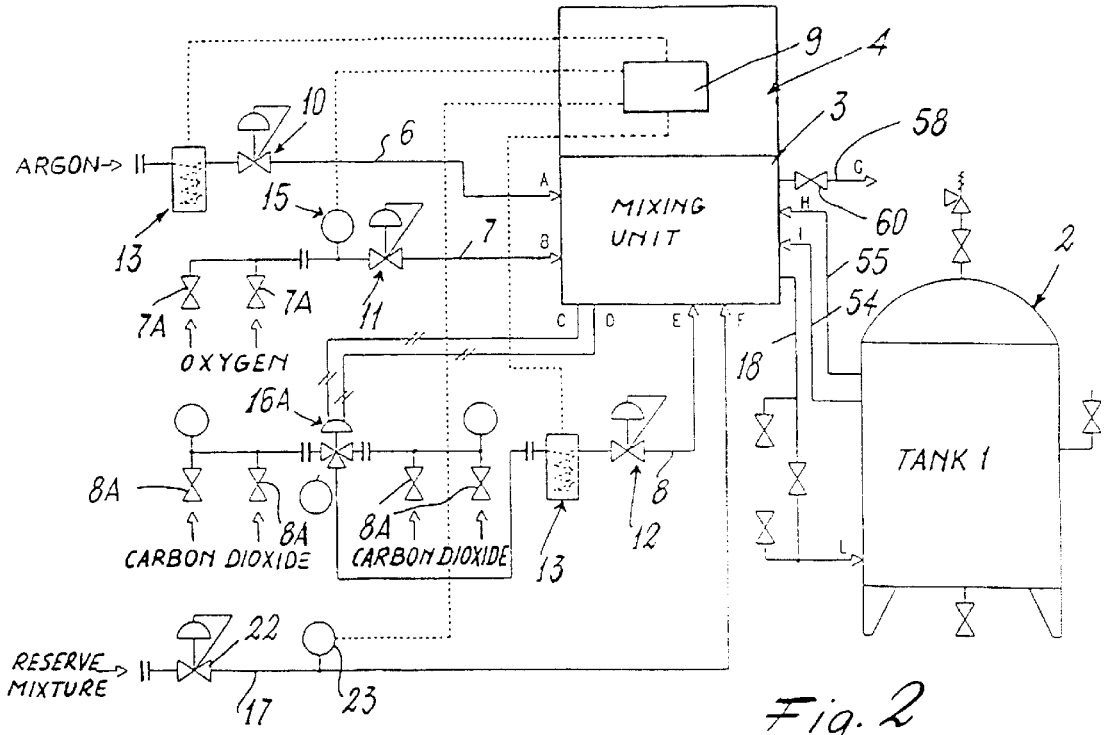
FIG. 2 is a schematic view of the plant of FIG. 1.

In the illustrated example, the oxygen and carbon dioxide are contained, as stated, in cylinders held in two racks (not shown) connected to the respective lines via valves 7A and 8A. Preferably each (compressed) gas is contained in a pair of cylinders selectively openable by the unit 9 via a circuit comprising rack change-over valves 16 and/or 16A shown in FIGS. 2 and 3. By this arrangement when a cylinder (or equivalent tank) is nearly empty (sensed by a suitable level indicator) the unit 9 switches over the circuit 16, 16A (consisting for example of solenoid valves) so as to cause the gas to be withdrawn from the other cylinder (still full) and enable the empty cylinder to be replaced.

The mixing unit 3 also receives a line 17 connecting this unit to a tank or a cylinder pack (not shown) containing mixture in the compressed state, representing a welding mixture already ready for use and composed of gas (argon, carbon dioxide and oxygen in this example) in a percentage equal to the optimum plant operating percentage, for example $CO_2$3% +0.2%, $O_2$1% ±0.1%, remainder argon. This reserve mixture is used to feed the user if for any reason the mixing plant is unable to produce in the unit 3 an argon-carbon dioxide-oxygen mixture in the said percentages. In this case the unit 9 interrupts the flow of these gases to the tank 2 (by operating a solenoid valve 19 positioned in an inlet line 18 to this tank, see FIG. 3), and activates the gas flow from the line 17 by opening the solenoid valve 20 shown in FIG. 3 and positioned in that portion of the line 17 contained in the unit 3 shown in this figure.

In the line 17 (see FIG. 2) there are also provided a pressure regulator 22 and a pressure transducer 23 connected to the unit 9, by means of which this latter measures the pressure in the line 17 and can control it as required.

As stated, the lines 6, 7 and 8 are connected to the unit 3.

Figure 3:
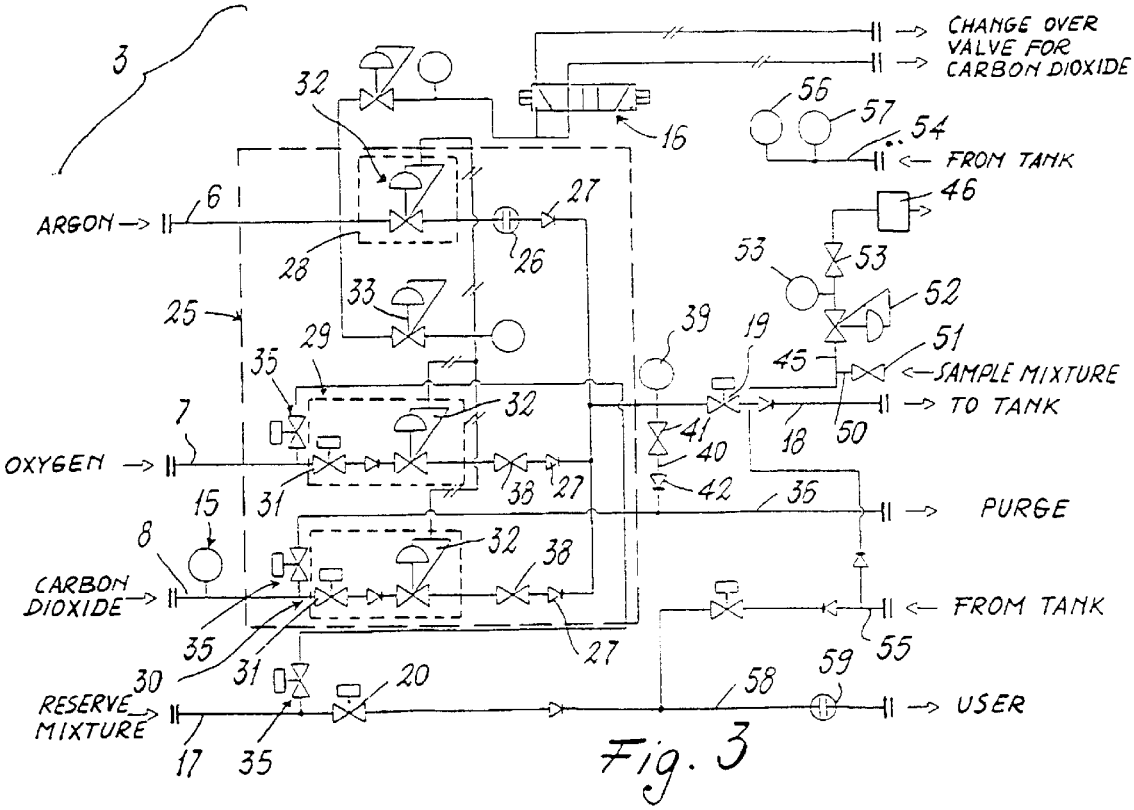
FIG. 3 is a schematic view of a part of the plant of FIG. 1.

Within this latter there is a circuit system indicated by 25 in FIG. 3, in which the welding mixture is prepared continuously or batchwise by feeding its component gases to the line 18 in the desired percentages. More specifically, in the line 6 there is a pressure "dimensioning" member 26 consisting of an orifice plate providing the desired argon flow rate downstream of it. In each line there is a non-return valve 27 and an assembly, indicated by 28, 29 and 30 for the lines,6;7 and 8 respectively, which comprises solenoid valves 31 (for the lines 7 and 8) and pressure regulators 32 (for all the lines). The assemblies 28, 29 and 30 are operationally connected together and to a pilot pressure regulator 33 which enables the unit 9 (to which this latter is connected) to maintain in the lines 6, 7 and 8 at the desired pressures for preparing the welding mixture. For example, the unit 9 measures the argon inlet pressure in the line 6 and, on the basis of the known pressure change effected by the member 26, acts on the assemblies 29 and 30 to regulate the oxygen and carbon dioxide pressures in the lines 7 and 8.

This is achieved by the pilot pressure regulator 33 connected to the regulators 32.

In the lines 7 and 8 there are also provided bleed means 35 defined by a solenoid valve connected to a purge line 36. The valve 35 relative to the $O_2$ line 7 is manual, whereas that relative to the $CO_2$ line is automatic in the sense that when the valve 16A is switched to the other rack, the valve 35 of this line 8 opens automatically to automatically bleed the circuit. It is obvious that if the $CO_2$ is stored in the liquid phase the rack change-over system provided for the cylinder $CO_2$ would not be required. In the lines 7 and 8 downstream of the assemblies 29 and 30 there are also provided solenoid valves 38 which regulate the percentages of the gases from the corresponding lines which are fed for mixing down the line 18. These solenoid valves are of needle type and can be operated manually or remotely, for example by the unit 9 of the system 4. If required, they can both be operated by one motor, with a separable insertion connector provided on the solenoid valves (alternatively, proportional solenoid valves can be provided for remote control).

As stated, the welding mixture, the pressure of which is measured by a pressure gauge 39, forms in the line 18. This line is also provided with a bleed line 40 comprising a solenoid valve 41 and a non-return valve 42, the line 40 being connected to the bleed line 36.

From the line IS there branches a branch line 45 terminating in an analyzer member 46 for verifying the exact percentage composition, within predetermined ranges, of the mixture fed to the buffer tank or vessel 2. The member 46 is connected to the unit 9 which, if this mixture is shown to have an incorrect composition, closes the solenoid valve 19 and opens the solenoid valve 20 to feed a mixture of predefined optimum composition to the user. To the branch 45 there is connected a line 50 provided with a valve 51 through which a sample mixture can be fed to the analyzer 46 for its calibration. A pressure regulator 52, a manometer 53 and a valve 54 controlled manually or remotely by the unit 9 are also connected into the branch line 45.

Two lines 54 and 55 return from the vessel or tank 2 to the unit 3. One of them, 54, terminates in pressure switches 56 and 57 which determine the minimum and maximum pressure within this tank.

The line 55 is connected to the line 58 which extends to the user and comprises an orifice plate 59 for setting a mixture user throughput level, and a valve 60 for adjusting the flow rate to the user. The orifice plate 59 safeguards proper plant operation and prevents any rapid fall in pressure in the vessel or tank 2. Specifically, the orifice plate 59 is dimensioned such that when under maximum delivery conditions (downstream pressure=0) it cannot deliver a flow rate greater than that produced. The orifice plate can be replaced by a proportional solenoid valve controllable on the basis of the pressure measured in the tank 2.

The plant comprises other usual components (non-return valves, solenoid valves, pressure regulators and the like) which are also shown in the figures, but are not described. These components are identified by the symbols normally used in the field to which this invention pertains and are well known to the average expert of the art. These components are therefore not described.

The method of the invention is implemented by the aforedescribed plant, and comprises the following steps:

a) withdrawing the individual mixture components from sources (which can be cylinders or tanks), heating at least some of them and feeding them to the mixer unit 3; the components are fed at a predetermined pressure;

b) monitoring the pressure of the individual fluids (preferably continuously) entering the unit 3, if necessary adjusting them (by the system 25) to a uniform value;

c) feeding the fluids at metered flow rates to the mixing line 18 in which they are mixed in determined percentages and from which they reach the buffer vessel or tank 2, the mixture then reaching the user through the line 58 as required (by opening a corresponding valve member positioned therein at the welding point or zone;

d) during this feed, mixture is withdrawn through the line 45 and fed to the previously calibrated analyzer 46; if this latter shows that the mixture composition is as desired and falls within a determined range, the mixture continues to reach the tank 2. If this is not the case, the analyzer 46 generates an alarm signal which is fed to the unit 9 to close the valve 19 and open the valve 20 to feed to the user the preformed mixture already compressed into a cylinder or cylinders connected to the line 17.

If the analyzer 46, which can be any known analyzer, including a mass analyzer, does not indicate an abnormal mixture composition, the mixture reaches the tank 2. The pressure is constantly monitored therein by the pressure switches 56 and 57. If this pressure rises above or falls below a predetermined value, the unit 9 (connected to the pressure switches) closes the valve 19 and opens the valve 20 to feed the reserve mixture to the user. In particular, acoustic and/or light-emitting devices can operate if the pressure in the line 6 (that which in this example contains argon) falls below a certain threshold, which can be due for example to an error in filling the cold evaporator in which the argon is contained.

As stated, the unit 9 controls all the operations of the plant 1, by verifying the opening or closure of all the solenoid or other valves (by usual sensors located within or downstream of them in the respective lines or pipes) such as to control and maintain at the desired value the composition of the mixture through the line 18, control the oxygen, carbon dioxide and argon feed and control the powering of the heaters 13. This unit also controls and oversees every alarm device present in the plant relative for example to the pressure in the tank 2 and in the argon tank, the correct operation of the rack change-over circuits 16 and 16A, the correct composition of the mixture fed to the tank 2, and the level therein and in the argon tank.

Additionally, the unit 9 is connected remotely to a supplier of argon, oxygen and carbon dioxide in order to inform the supplier in good time of the level in the respective tanks or cylinders. By means of this remote connection, for example via a telephone line or via radio, the operation of the entire plant 1 can also be monitored, with possible intervention on its components, for example the solenoid valves 19 and 20, to adjust the mixture flow to the user (on the basis of its composition in the described example). In this manner the composition of such a mixture can be monitored and adjusted remotely by regulating the flow of fluids to the line 18. At the same time, by virtue of this remote connection, said supplier or the plant supervisor can know the "history" of the plant operation as the data received by the unit 9 can be memorized over a long period on an optical or magnetic support and then analyzed and evaluated.

A description has been given of a method according to the invention and a plant for implementing it. Modifications to the plant or method which can be considered as derivable by an expert of the art from the aforegoing description are to be considered as falling within the scope of this invention. The described embodiment of the invention relates to a ternary mixture composed of $O_2$, Ar and $CO_2$, where the Ar and, if desired, also the $CO_2$ are originally present in the liquid phase. However other compositions, including binary compositions such as Ar+$CO_2$, AR+He or Ar+He+$CO_2$ also fall within the scope of the invention.

In the case of a composition consisting of Ar+$CO_2$ the plant will be as described but without the part pertaining to the $O_2$ (for example the line 7 in particular). In the case of a composition consisting of Ar+He the helium will be fed in place of the $CO_2$ and the part relative to the $O_2$ will be omitted. In the case of the ternary composition Ar+He+$CO_2$ the plant will be as described but with He replacing the $O_2$.

What is claimed is:

1. A method for preparing a welding fluid at the welding site, said welding fluid defined by a mixture of at lest two components, these being present in said mixture in metered percentages, which have to be maintained to allow adequate welding, said method comprising the following steps:

withdrawing the mixture components from respective sources located at the welding site and feeding them to a mixture zone (18) located at the welding site at substantially identical pressures;

monitoring the composition of the formed mixture at the welding site to check whether its components are present in desired percentages;

if the composition is correct, feeding the hence formed mixture to a containing means (2) in which the mixture is stored at the welding site under pressure;

selectively feeding said mixture to a user locating at the welding site; and selecting the qualitative composition of the welding fluid from the group consisting of:

Ar+He,

Ar+$CO_2$,

Ar+He+$CO_2$,

Ar+$O_2$+$CO_2$.

2. A method as claimed in claim 1, wherein the composition of the formed mixture is monitored by analysing its components.

3. A method as claimed in claim 1, wherein the composition of the formed mixture is monitored by analysing its mass.

4. A method as claimed in claim 1, wherein the original components are stored at low temperature and are then heated before mixing.

5. A method as claimed in claim 1, wherein the pressure of the individual mixture components is monitored prior to their mixing, the pressure of one or more of them being varied so that they all equal a preselected value.

6. A method as claimed in claim 5, wherein the pressure variation is effected on the basis of the measured pressure of one of said components.

7. A method as claimed in claim 1, wherein a preconstituted welding mixture of known characteristics stored in a respective containing member is fed whenever the mixture formed from the individual components has an unacceptable composition, said feed being obtained having at least simultaneously interrupted, or having already previously interrupted, the feed to the buffer tank of said mixture formed from the individual components.

8. A method as claimed in claim 1, further comprising by remotely monitoring the execution of its various steps, said monitoring comprising obtaining data relative to said steps and feeding said data to a remote station, from this latter it being possible to intervene on the execution of said individual steps in order to optimize the mixture composition and its physical characteristics, in particular its pressure.

9. A plant for forming a welding mixture at the welding site, said plant comprising means located at the welding site for containing at least two components to be mixed to form a welding mixture, said components being at predefined pressure and temperature, mixer means (25, 28) located at the welding site for mixing said components at a predefined constant pressure, analyzer means (46) at the welding site for analyzing the mixture obtained, and storage means (2) at the welding site for said mixture, to contain said mixture until it is fed to a user for making a weld, means for selectively feeding said mixture to said user at the welding site; and wherein the qualitative composition for the welding mixture is selected from the group consisting of Ar+He; Ar+$CO_2$; Ar+He+$CO_2$ and Ar+$O_2$+$C_2$.

10. A plant as claimed in claim 9, wherein the mixer means are a mixing pipe (18) to which a plurality of component feed lines (6, 7, 8) lead, and a mixing system (25) comprising means for regulating the pressure of said feed lines (6, 7, 8).

11. A plant as claimed in claim 10, wherein the mixing system (25) comprises pressure regulator means (32) positioned in the component feed lines (6, 7, 8) connected to control means (9) arranged to measure the pressures of the components in the respective lines (6, 7, 8) and to regulate them so that they are equal to each other.

12. A plant as claimed in claim 10, wherein the mixing system (25) comprises bleed means (35, 36) arranged to bleed at least one feed line (7, 9) for the mixture components.

13. A plant as claimed in claim 9, wherein the analyzer means for the mixture obtained are an analyzer (46) which determines the component percentages of said mixture, said analyzer being connected to the mixing pipe at a point between the point at which the feed pipes (6, 7, 8) join it and the storage means (2).

14. A plant as claimed in claim 9, wherein the analyzer means for the mixture obtained are a mass analyzer which analyzes the mixture directed towards the storage means (2).

15. A plant as claimed in claim 9, wherein the analyzer means (46) are connected to the control means (9), these latter interrupting the mixture flow to the storage means (2) and feeding to the user a preconstituted mixture stored in a suitable container member, whenever unacceptable mixture compositions are determined.

16. A plant as claimed in claim wherein the control means (9) are a controlof the microprocessor type.

17. A plant as claimed in claim 16, wherein the control unit (9) controls a plurality of plant valve means (7A, 8A, 19, 20, 31, 35, 38, 60), pressure regulator means (10, 11, 12, 32) for the components flowing to the mixing pipe, alarm means and acoustic and/or light-emitting indicators provided in the plant.

18. A plant as claimed in claim 17, wherein the control unit (9) comprises receiver-transmitter means or means for remote-feeding signals along a telephone line in order to feed to a distance data concerning the plant components and its activity, and to receive from a remote control and operating member information for intervening on said components and modifying the plant activity, in particular the feeding of the welding mixture obtained from the plurality of individual components to the storage means (2).

19. A plant as claimed in claim 9, wherein the storage means are a storage tank (2) arranged to be maintained at a pressure greater than or equal (less pressure drops) to the operating pressure at the user.

20. A plant as claimed in claim 9, further comprising heater members (13) for the components fed to mixing, said members being connected to the control unit (9) and controlled by this latter.

* * * * *